United States Patent [19]

Mike

[11] Patent Number: 4,720,126

[45] Date of Patent: Jan. 19, 1988

[54] INTEGRATED POWER RELAY FOR ELECTRIC STARTER MOTOR

[75] Inventor: Anthony G. Mike, Big Flats, N.Y.

[73] Assignee: Facet Enterprises, Inc., Elmira, N.Y.

[21] Appl. No.: 908,739

[22] Filed: Sep. 18, 1986

[51] Int. Cl.[4] ..... F02N 11/00; F02N 11/06; F02N 17/00

[52] U.S. Cl. ..... 290/38 R; 290/38 C; 290/40 R; 123/179 M

[58] Field of Search ..... 290/38 R, 38 C, 40 R, 290/38, 45, 8, 37 A, 37 R, 36 R, 33, DIG. 1, DIG. 11; 123/179 M, 179 J, 179 B, 179 G; 361/183; 180/54 R, 286, 287; 74/6, 7 R, 7 C

[56] References Cited

U.S. PATENT DOCUMENTS

| | | | |
|---|---|---|---|
| 3,124,694 | 3/1964 | Seilly | 290/38 |
| 3,177,368 | 4/1965 | Seilly | 290/38 |
| 3,210,554 | 10/1965 | Seilly et al. | 290/38 |
| 3,358,667 | 12/1967 | Gubb et al. | 123/179 |
| 3,465,353 | 9/1969 | Buxton et al. | 74/7 |
| 4,156,817 | 5/1979 | Preece et al. | 290/38 R |
| 4,305,002 | 12/1981 | Mortensen | 290/38 R |
| 4,366,385 | 12/1982 | Williams | 290/38 R |
| 4,464,576 | 8/1984 | Williams | 290/38 R |
| 4,481,424 | 11/1984 | Hattori et al. | 290/38 R |

*Primary Examiner*—William M. Shoop, Jr.
*Assistant Examiner*—Sharon D. Logan
*Attorney, Agent, or Firm*—Remy J. VanOphem

[57] ABSTRACT

A starter relay disposed in the housing of an electric starter of an internal combustion engine. The starter relay has a pair of stationary contact members electrically connected by a movable bar contact. The movable bar contact is mechanically linked to an annular relay armature which is axially displaceable by an annular electromagnetic coil. A coil spring produces a force biasing the relay armature away from the electromagnetic coil and the movable bar contact away from the contact members. In the preferred embodiment the operation of the power relay is transparent to the operation of the starter drive mechanism and the annular electromagnetic coil is the electromagnetic coil of the existing started drive mechanism.

18 Claims, 6 Drawing Figures

INTEGRATED POWER RELAY FOR ELECTRIC STARTER MOTOR

BACKGROUND OF THE INVENTION

1. Field of the Invention

The invention is a power relay for an electric starter motor of an internal combustion engine and, in particular, a power relay which is integrated in the starter motor's housing.

2. DESCRIPTION OF THE PRIOR ART

The power or starter relays used to supply electrical power to the electric motor of a starter for an internal combustion engine were initially a discrete element independent of the starter motor or the starter assembly. However, the current trend is to integrate these power relays with the starter assemblies themselves, as disclosed by Mortensen, in U.S. Pat. No. 4,305,002. In this electric starter, disclosed by Mortensen, the power relay is integrated with a starter solenoid used to physically displace the starter's pinion gear to engage the engine's ring gear. The present invention is a power relay integrated with an electric starter having a starter drive of the type disclosed by J. O. Williams in U.S. Pat. No. 4,464,576. This starter drive mechanism does not have a starter solenoid but has an internal electromagnetic coil which, when actuated, clamps an armature plate to engage a unidirectional clutch.

SUMMARY OF THE INVENTION

The present invention is a power relay integrated into the housing of an electrical starter for an internal combustion engine. The electrical starter is of the type having a starter housing, a starter drive mechanism disposed in the starter housing, and an electric starter motor for rotating a toothed gear of the internal combustion engine through the starter drive mechanism. The starter drive mechanism has an annular electromagnetic coil operative to be energized from an external source of electrical power through a starter switch. The integrated power relay includes a relay chamber provided in the starter housing radially offset from the electromagnetic coil, an electrical switch disposed in the relay chamber, the electrical switch having a power input terminal for receiving electrical power from the external source, and a power output terminal connected to the starter motor. The power relay further has an axially displaceable annular relay armature disposed in the starter housing concentric with the electromagnetic coil, the relay armature being connected to the electrical switch and operativ to actuate the electrical switch to a closed position to provide electrical power to the starter motor in response to energizing the electromagnetic coil and resilient means for producing a force biasing the relay armature away from the electromagnetic coil and actuating the electrical switch to an open position. The object of the invention is to integrate a power relay into the housing of an electrical starter of the type having a starter drive as disclosed in U.S. Pat. No. 4,464,576. Another object of the invention is to provide a power relay to an electrical starter which uses elements already existing in the electrical starter. These and other objects of the invention will become clear from a further reading of the detailed description of the invention in conjunction with the drawings.

DETAILED DESCRIPTION OF THE PREFERRED EMBODIMENT

Figure 1:
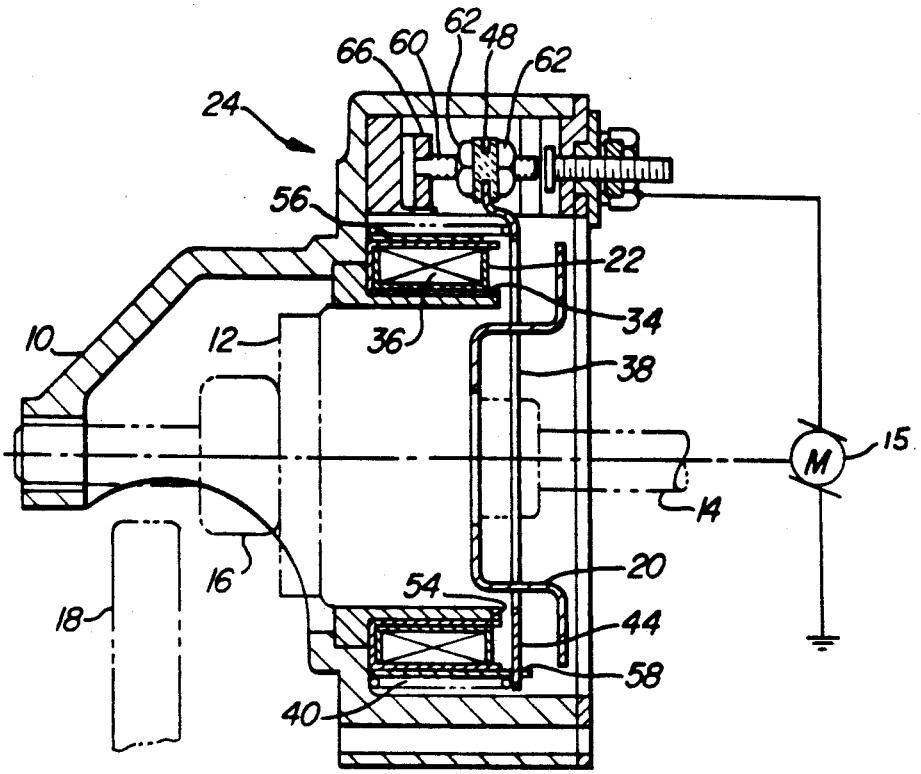
FIG. 1 is a cross-sectional view of the nose housing of an electrical starter embodying the integrated power relay.
Figure 3:
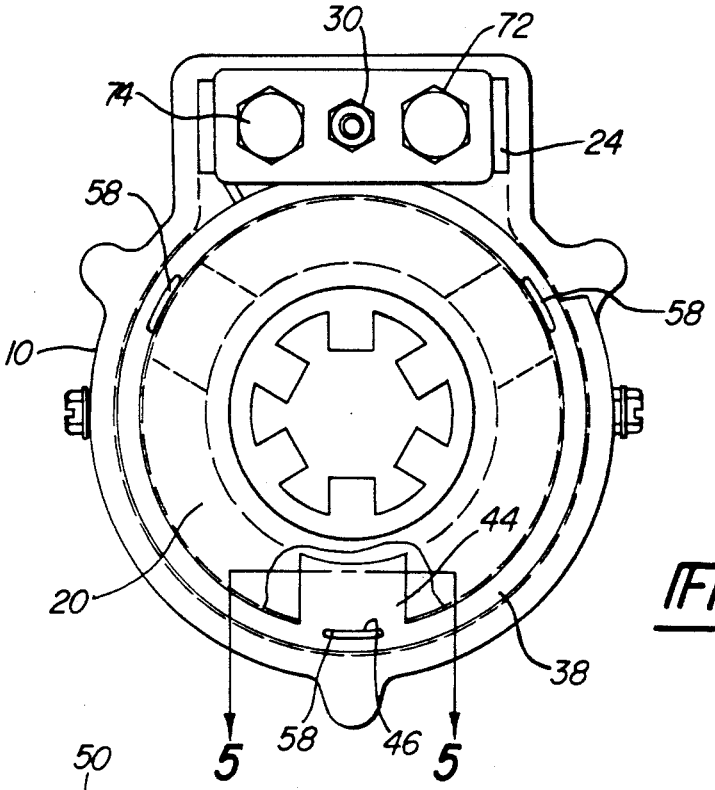
FIG. 3 is an end view of the nose housing shown in FIG. 1.

Referring to FIGS. 1 and 3, there is shown the nose housing 10 of an electrical starter for an internal combustion engine of the type disclosed in U.S. Pat. No. 4,464,576 which houses a starter drive 12 shown in phantom. The starter drive 12 is attached to a drive shaft 14 of an electric starter motor 15. As described in U.S. Pat. No. 4,464,576, when the electric starter motor 15 is energized to rotate the drive shaft 14 the starter drive 12 will be displaced longitudinally along the drive shaft 14 causing a pinion gear 16 to engage a ring gear 18 of the internal combustion engine. When the pinion gear 16 is fully engaged with the ring gear 18, an armature plate 20 which is part of the starter drive 12 engages the edge of a stationary electromagnetic coil assembly 22 which also is a part of the starter drive 12. The electromagnetic coil assembly 22 when energized clamps the armature plate 20 to itself and prevents the armature plate 20 from rotating. This causes a unidirectional clutch in the starter drive 12 to engage and rotatably connect the drive shaft 14 of the starter motor 15 with the pinion gear 16. The pinion gear 16 now directly driven by the starter motor, will rotate the ring gear 18 to crank the internal combustion engine.

Figure 2:
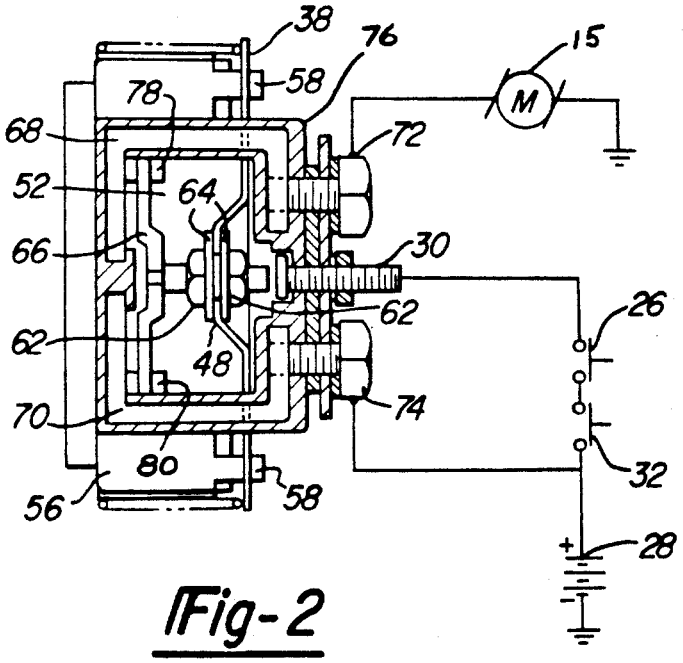
FIG. 2 is a cross-sectional view showing the details of the power relay.

The invention is a power relay 24 integral with the starter motor nose housing 10 for providing electrical power to the starter motor 15 in response to the energizing of the electromagnetic coil assembly 22 of the starter drive 12. The coil assembly 22 is energized by closing a starter switch 26 as shown in FIG. 2.

One terminal of the starter switch 26 is connected to a coil terminal 30 of the power relay 24 and the other terminal is connected to the positive terminal of the vehicle's battery 28 through a transmission switch 32. The transmission switch 32 is a conventional safety feature which prevents energizing the electrical starter except when the vehicle's transmission is in the neutral or park position. The negative terminal of the vehicle's battery 28 and the nose housing 10 are connected to a common ground in a conventional manner.

The coil assembly 22 has an annular stator 34 and a coil winding 36 electrically connected to the coil terminal 30. The annular stator 34 has a U-shaped cross-section as shown in FIG. 1 which encloses the coil winding 36 on three sides. The fourth side of the U-shaped stator is an opened face which is closed by the armature plate 20 when the starter drive 12 is displaced towards the ring gear 18. A relay armature 38 is disposed adjacent to the open face of the coil assembly 22 and is resiliently biased away from the coil assembly by a coil spring 40.

Figure 4:
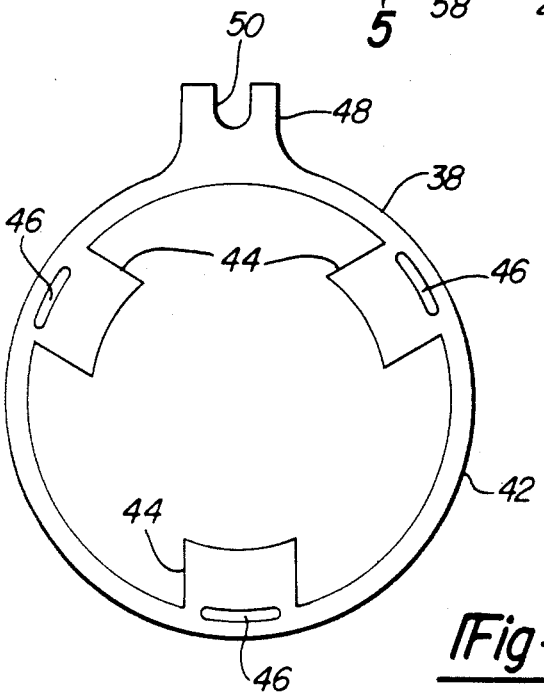
FIG. 4 shows the configuration of the relay armature.

Referring now to FIG. 4, the relay armature 38 has an annular rim 42 and three equally spaced radial tabs 44 extending inwardly from the annular rim 42. An arcuate slot 46 is formed at the base of each radial tab 44 where it connects to the annular rim 42. The relay armature 38 also has a fork 48 extending outwardly from the annular rim 42. A slot 50 is provided at the end of the fork 48 to facilitate its connection to the movable elements of the power relay 24. As more clearly shown in FIG. 1, the fork 48 is offset from the plane of the annular rim 42 and extends into a power relay chamber 52.

Figure 5:
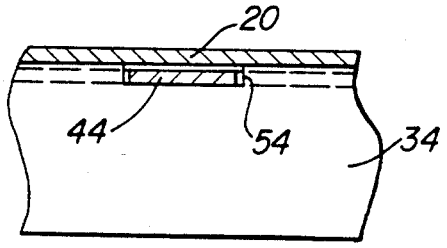
FIG. 5 is a partial cross-sectional view showing the detent in the starter for receiving tabs of the relay armature.

Three equally spaced radial notches 54 are provided on the open face of the annular stator 34 in line with the radial tabs 44 of the relay armature 38. As shown more clearly in FIG. 5 the notches 54 receive the radial tabs 44 when the relay armature 38 is displaced against the annular stator 34 when the coil winding 36 is energized. The depth of the notches 54 is selected so that when the relay armature 38 engages the annular stator 34 its surface does not protrude beyond the plane formed by the open face of the annular stator 34 as shown in FIG. 5. This permits the armature plate 20 of the starter drive 12 to directly engage the open face of the annular stator 34 when the starter drive 12 is linearly displaced by the starter motor to engage the ring gear 18. Because the notches 54 permit the relay armature 38 to be displaced below the open face of the annular stator 34, the relay armature is transparent to the operation of the starter drive and does not interfere or alter its operation.

Referring back to FIGS. 1, 2, and 3, the electromagnetic coil assembly 22 is circumscribed by a thin wall annular housing 56 having three equally spaced tabs 58. The tabs 58 project through the arcuate slots 46 of the relay armature 38 and support the relay armature 38 concentric with the electromagnetic coil assembly 22.

As shown in FIGS. 1 and 2, a threaded shaft 60 passes through an annular insulator 64 having a circumferential groove which is received in the slot 50 formed in the end of the fork 48 of the armature relay 38. The threaded shaft 60 is locked in place by a pair of opposing lock nuts 62, one on each side of the insulator 64. A movable bar contact 66 of the power relay 24 is connected to the end of the threaded shaft 60. The movable bar contact 66 is displaced by the relay armature 38 to engage a pair of U-shaped stationary contact members 68 and 70. The stationary contact member 68 has a threaded bore which receives a threaded bolt which functions as the starter motor terminal 72 for the power relay. The stationary contact member 70 has a threaded bore which receives a threaded bolt which functions as the battery terminal 74 for the power relay 24. A plastic housing 76 supports the stationary contact members 68 and 70, the starter motor terminal 72, the battery terminal 74, and the coil terminal 30. The housing 76 also has a pair of guide tabs 78 and 80 which support the ends of the movable bar contact 66 relative to the U-shaped stationary contact members 68 and 70.

The battery terminal 74 of the power relay is connected directly to the positive terminal of the battery 28 while the starter motor terminal 72 is connected directly to the starter motor 15 which rotates the drive shaft 14.

OPERATION OF THE INVENTION

When the vehicle's transmission is in the neutral or park position and the starter switch 26 is closed, the electromagnetic coil assembly 22 is energized by the battery 28. Energizing the electromagnetic coil assembly 22 produces a magnetic field which attracts the relay armature 38. The fork 48 of the relay armature 38 displaces the threaded shaft 60 causing the movable bar contact 66 to engage the stationary contacts 68 and 70. The engagement of the movable bar contact 66 with the stationary contacts 68 and 70 applies electrical power from the battery 28 to the starter motor 15. The drive shaft 14 of the starter motor 15 will start to rotate which will cause the starter drive 12 to be linearly displaced to engage the pinion gear 16 with the engine's ring gear 18. The displacement of the starter drive 12 will also cause the armature plate 20 to engage the open face of the coil assembly's annular stator 34. The magnetic field produced by the electromagnetic coil assembly 22 will clamp the armature plate 20 to the annular stator 34 preventing its rotation with the starter motor's drive shaft 14. This will cause the unidirectional clutch in the starter drive 12 to engage connecting the pinion gear 16 to the starter motor's drive shaft 14. The pinion gear 16 will then rotate the engine's ring gear 18 cranking the engine.

When the engine starts, the starter switch 26 is opened, de-energizing the electromagnetic coil assembly 22 and terminating the magnetic field attracting the relay armature 38 and the armature plate 20 to the electromagnetic coil assembly 22. The running engine will rotate the starter drive 12 at a speed greater than the rotational speed of the starter motor 15 which will cause the starter drive 12 to be linearly displaced in the opposite direction disengaging the pinion gear 16 from the engine's ring gear 18 and disengaging the armature plate 20 from the electromagnetic coil assembly 22. The coil spring 40 will then displace the relay armature 38 away from the electromagnetic coil assembly 22 which will disengage the movable bar contact 66 from the stationar contact members 68 and 70. The disengagement of the movable bar contact 66 from the stationary contact members 68 and 70 will de-energize the starter motor 15. By the time the starter motor 15 is de-energized, all of the elements of the starter drive and the power relay 24 are returned to their original pre-start positions.

Figure 6:
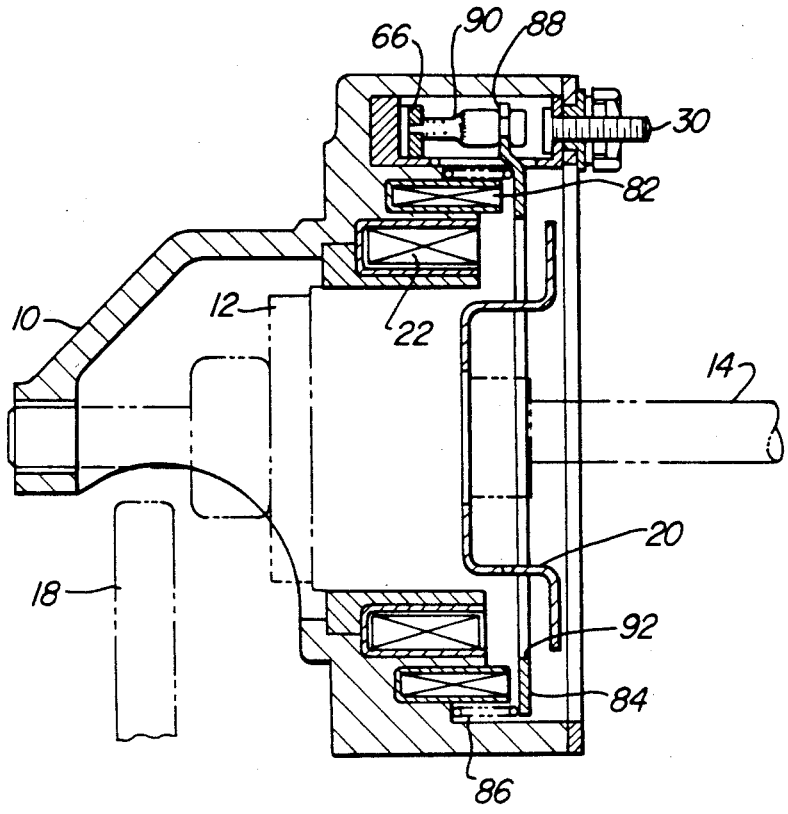
FIG. 6 is an alternate embodiment of the invention using a second annular electromagnetic coil for actuating the power relay.

An alternate embodiment of the integral power relay is illustrated in FIG. 6. In this embodiment a second electromagnetic coil assembly 82 is used to displace a relay armature 84 to move the movable bar contact 66 into engagement with the stationary contact members 68 and 70, as shown in FIG. 2. A resilient member, such as a coil spring 86 biases the relay armature 84 away from the electromagnetic coil assembly 82 and the movable bar contact 66 away from the stationary contact members 68 and 70, as described with reference to the embodiments of FIGS. 1 and 2. A fork 88 extending radially from the relay armature 84 is captivated in an annular groove provided in a drive pin 90. The end of the drive pin 90 is connected to the movable bar contact 66 and will displace the movable bar contact 66 with a displacement of the relay armature 84. The relay armature 84 has a central aperture 92 which is sufficiently large to permit the armature plate 20 of the starter drive 12 to pass through the relay armature when the starter drive 12 is displaced to engage the pinion gear 16 with the engine's ring gear 18. The electromagnetic coil assembly 22 is only used to rotationally lock the starter drive's armature plate 20 when the pinion gear 16 is fully engaged with the engine's ring gear 18.

The coils of the electromagnetic coil assemblies 22 and 82 are commonly connected to the coil terminal 30 and are energized when the starter switch, such as the starter switch 26 illustrated in FIG. 2, is closed. The operation of the alternate embodiment shown in FIG. 6 is substantially the same as described relative to FIGS. 1, 2, and 3 and need not be repeated for an understanding of the invention.

It is not intended that the invention be limited to the exact embodiment shown on the drawings and discussed in the specification. Those skilled in the art will recognize that the structure may be changed without departing from the spirit of the invention as disclosed in the drawings and set forth in the appended claims.

What is claimed is:

1. A power relay integrated in the electrical starter of an internal combustion engine, the electrical starter being of the type having a starter housing, a starter drive mechanism disposed in said starter housing, a pinion gear engageable with a toothed gear of an internal combustion engine, and an electrical starter motor having a rotary output connected to said starter drive mechanism, said starter drive mechanism having an annular electromagnetic coil operative to be energized from an external source of electrical power through a starter switch, and a unidirectional clutch having an armature plate disposed adjacent to said electromagnetic coil and concentric therewith, said armature plate being clamped against said electromagnetic coil to engage aid unidirectional clutch and couple the rotary output of said electrical starter motor to said pinion gear when said pinion gear is fully engaged with said engine's toothed gear, said power relay comprising:

a relay chamber provided in said starter housing radially offset from said electromagnetic coil;

an electrical switch disposed in said relay chamber, said electrical switch having a power input terminal for receiving electrical power from an external source and a power output terminal connected to said starter motor;

an axially displaceable annular relay armature disposed in said starter housing between said electromagnetic coil and said armature plate of said drive mechanism, said relay armature being connected to said electrical switch and operative to actuate said electrical switch to a closed position to provide electrical power to said starter motor in response to the energizing of said electromagnetic coil; and resilient means for producing a force biasing said relay armature away from said electromagnetic coil and actuating said electrical switch to an open position.

2. The power relay of claim 1 wherein said electrical switch comprises:

a first stationary contact member connected to said power input terminal;

a second stationary contact member connected to said power output terminal;

a bar contact mechanically linked to said relay armature, said bar contact being movable with said relay armature from a first position displaced away from said first and second contact members to a second position electrically connecting said first and second stationary contact members.

3. The power relay of claim 2 wherein said relay armature has a radial fork extending into said relay chamber, said radial fork being mechanically linked to said bar contact and operative to displace said bar contact with the displacement of said relay armature.

4. The power relay of claim 3 wherein said electrical switch further includes a plastic housing rigidly supporting said first and second stationary contact members in said housing and for slidably supporting said bar contact for displacement between said first and second positions.

5. The power relay of claim 1 wherein said electromagnetic coil is enclosed in an annular stator having a U-shaped cross-section, the open end of said U-shaped cross-section forming a planar surface adjacent to said relay armature.

6. The power relay of claim 5 wherein said relay armature has an annular rim, the internal diameter of which is larger than the external diameter of said annular stator, and at least two equally spaced radial tabs extending inwardly from said annular rim a distance sufficient to partially close the open end of said U-shaped cross-section of said annular stator when said relay armature is displaced to engage said annular stator in response to the energizing of said electromagnetic coil.

7. The power relay of claim 6 wherein said annular stator has a plurality of equally spaced notches provided on the surface formed by the open end of said U-shaped cross-section, each of said notches receiving a respective one of said at least two radial tabs of said relay armature, and each of said notches having a depth at least equal to the thickness of said relay armature.

8. The power relay of claim 7 having means for slidably supporting said relay armature concentric with said electromagnetic coil.

9. An electrical starter for rotating a toothed gear of an internal combustion engine comprising:

a housing;

a starter drive mechanism having a torque input, a pinion gear axially displaceable to engage said toothed gear of said internal combustion engine, an electromagnetic coil, and a unidirectional clutch having an armature plate operative to be clamped against rotation by said electromagnetic coil when said pinion gear is fully engaged with said toothed gear to transfer the torque received at said torque input to said pinion gear;

a starter motor disposed in said housing for providing a torque to said torque input of said starter drive mechanism;

a relay chamber provided in said housing radially offset from said electromagnetic coil;

an electrical switch provided in said relay chamber, said electrical switch having an input terminal for receiving power from an external source and an output terminal to said starter motor;

an axially displaceable relay armature dispossed in said housing intermediate said electromagnetic coil and said armature plate, asid relay armature being mechanically connected to said electrical switch and operative to actuate said electrical switch from an open position to a closed position in response to being attracted to said electromagnetic coil when said electromagnetic coil is energized, said electrical switch in said closed position providing electrical power to said starter motor; and resilient means for producing a force biasing said relay armature away from said electromagnetic coil to actuate said electrical switch to said open position.

10. The electric starter of claim 9 wherein said electrical switch comprises:

a first stationary contact member connected to said input terminal;

a second stationary contact member connected to said output terminal; and a bar contact mechanically linked to said relay armature and movable therewith, said bar contact being movable from a first position displaced away from said first and second stationary contact members to a second position electrically connecting said first and second contact members, wherein said first position of said bar contact is indicative of an open position of said electrical switch and said second position of said bar contact is indicative of the closed position of said electrical switch.

11. The electrical starter of claim 10 wherein said relay armature has a radial fork extending into said relay chamber, said radial fork being mechanically linked to said bar contact and operative to displace said bar contact between said first and second positions with the axial displacement of said relay armature.

12. The electrical starter of claim 11 wherein said electrical switch further includes a plastic structure rigidly supporting said first and second stationary contact members in said relay chamber and slidably supporting said bar contact for displacement between said first and second positions.

13. The electrical starter of claim 9 wherein said electromagnetic coil is enclosed in an annular stator having a U-shaped cross-section, the opened end of said U-shaped cross-section forming a planar surface adjacent to said relay armature.

14. The electrical starter of claim 13 wherein said relay armature has an annular rim, the internal diameter of which is greater than the external diameter of said annular stator, and a plurality of equally spaced radial tabs extending inwardly from the annular rim a distance sufficient to partially close the open end of said U-shaped cross-section of said annular stator in the regions where said radial tabs engage said annular stator when the electromagnetic coil is energized.

15. The electrical starter of claim 14 wherein said annular stator has a plurality of equally spaced notches provided o said annular stator each of said notches receiving a respective one of said plurality of radial tabs of said relay armature and each of said plurality of equally spaced notches having a depth at least equal to the thickness of said relay armature.

16. The electrical starter of claim 15 having means for slidably supporting said relay armature concentric with said annular stator.

17. The electrical starter of claim 9 wherein said electromagnetic coil comprises two concentrically disposed electromagnetic coils, the first of said two electromagnetic coils having a smaller diameter than the second of said two electromagnetic coils, said first electromagnetic coil when energized clamping said armature plate against rotation, and said second electromagnetic coil when energized axially displacing said relay armature to place said electrical switch in said closed position.

18. An electrical starter for rotating a toothed gear of an internal combustion engine comprising:

a housing;

a starter drive mechanism having a torque input and a pinion gear axially displaceable to engage said toothed gear of said internal combustion engine and unidirectional clutch means having an electromagnetic coil and an annular armature plate disposed adjacent to one end of said electromagnetic coil and concentric therewith for mechanically connecting said torque input to said pinion gear when said pinion gear is fully engaged with said toothed gear and said armature plate is clamped against rotation by said electromagnetic coil;

a starter motor disposed in said housing for providing a torque to said torque input of said starter drive mechanism;

a relay chamber provided in said housing radially offset from said electromagnetic coil;

an electrical switch provided in said relay chamber, said electrical switch having an input terminal for receiving electrical power from an external source and an output terminal connected to said starter motor;

an axially displaceable relay armature disposed in said starter housing concentric with said electromagnetic coil and intermediate said electromagnetic coil and said armature plate, said relay armature being mechanically linked to said electrical switch and operative to actuate said electrical switch from an open position to a closed position to provide electrical power to said starter motor in response to being displaced towards said electromagnetic coil when aid electromagnetic coil is energized; and resilient means for producing a force biasing said relay armature away from said electromagnetic coil and actuating said electrical switch to said open position.

* * * * *

UNITED STATES PATENT AND TRADEMARK OFFICE

CERTIFICATE OF CORRECTION

PATENT NO. : 4,720,126

DATED : January 19, 1988

INVENTOR(S) : Anthony G. Mike

It is certified that error appears in the above-identified patent and that said Letters Patent is hereby corrected as shown below:

Column 1, line 52, delete "operativ" and insert ---- operative ----.

Column 2, line 40, delete "16 now" and insert ---- 16, now ----.

Column 3, line 13, after "34" insert a comma ---- , ----.

Column 4, line 36, delete "stationar" and insert ---- stationary ----.

In the Claims

Column 5, line 28, delete "aid" and insert ---- said ----.

Column 6, line 53, delete "dispossed" and insert ---- disposed ----.

Column 6, line 55, delete "asid" and insert ---- said ----.

Column 7, line 47, delete "o" and insert ---- on ----. Same line, after "stator" insert a comma ---- , ----.

Signed and Sealed this

Fifteenth Day of November, 1988

*Attest:*

*Attesting Officer*

DONALD J. QUIGG

*Commissioner of Patents and Trademarks*